US011547929B2

(12) United States Patent
Keller et al.

(10) Patent No.: US 11,547,929 B2
(45) Date of Patent: Jan. 10, 2023

(54) INTERACTIVE PLAY SYSTEM

(71) Applicant: Landscape Structures Inc., Delano, MN (US)

(72) Inventors: Thomas L. Keller, Delano, MN (US); Bruce Manning Bowman, Franklin, TN (US); Ronald Vance Simmons, Franklin, TN (US); Lau Kofoed Kierstein, Vejle (DK)

(73) Assignee: Landscape Structures, INC., Delano, MN (US)

( * ) Notice: Subject to any disclaimer, the term of this patent is extended or adjusted under 35 U.S.C. 154(b) by 258 days.

(21) Appl. No.: 17/097,657

(22) Filed: Nov. 13, 2020

(65) Prior Publication Data

US 2021/0146185 A1 May 20, 2021

Related U.S. Application Data

(60) Provisional application No. 62/935,262, filed on Nov. 14, 2019.

(51) Int. Cl.

| | |
|---|---|
| ***A63G 31/00*** | (2006.01) |
| ***A63F 9/24*** | (2006.01) |
| *A63B 9/00* | (2006.01) |

(52) U.S. Cl.

CPC ..... *A63F 9/24* (2013.01); *A63B 2009/006* (2013.01); *A63F 2009/247* (2013.01);

(Continued)

(58) Field of Classification Search

CPC ... A63G 31/00; A63F 9/24; A63F 2009/2442; A63F 2009/2451; A63F 2009/247; A63F 2009/2487

See application file for complete search history.

(56) References Cited

U.S. PATENT DOCUMENTS 8,665,118 B1 † 3/2014 Woodard
2008/0293470 A1* 11/2008 Proud ..... A63F 9/24 463/9

(Continued)

FOREIGN PATENT DOCUMENTS

EP 3 546 034 A1 † 10/2019
EP 3546034 A1 10/2019

(Continued)

OTHER PUBLICATIONS

International Search Report and Written Opinion for International Patent Application No. PCT/US2020/060446, dated Mar. 2, 2021, 11 pages.

*Primary Examiner* — Corbett B Coburn
(74) *Attorney, Agent, or Firm* — Christopher R. Christenson; Kelly, Holt & Christenson, PLLC

(57) ABSTRACT

Embodiments of an interactive play system are provided. In one such embodiment, an interactive play system includes a satellite having a sensor. The satellite is integrated within a component included within a playground environment. A feedback mechanism is also provided within the playground environment. A computing device supports a selective change between a first programming state in which the feedback mechanism will respond to an actuation of the sensor based on a computer instruction provided by a system administrator and a second programming state in which the feedback mechanism will respond to an actuation of the sensor based on a computer instruction provided by someone other than a system administrator.

20 Claims, 6 Drawing Sheets

(52) U.S. Cl.
CPC ..... *A63F 2009/2442* (2013.01); *A63F 2009/2451* (2013.01); *A63F 2009/2485* (2013.01); *A63G 31/00* (2013.01)

(56) References Cited

U.S. PATENT DOCUMENTS

| | | | | |
|---|---|---|---|---|
| 2009/0105001 | A1† | 4/2009 | Burgaard | |
| 2021/0201914 | A1* | 7/2021 | Gagné et al. | A63G 33/00 |

FOREIGN PATENT DOCUMENTS

| | | | | |
|---|---|---|---|---|
| FR | 2977503 | A1 * | 1/2013 | A63G 31/00 |
| KR | 1020080023000 | A | 3/2008 | |

* cited by examiner
† cited by third party

INTERACTIVE PLAY SYSTEM

CROSS-REFERENCE TO RELATED APPLICATION

The present application is based on and claims the benefit of U.S. provisional patent application Ser. No. 62/935,262, filed Nov. 14, 2019, the content of which is hereby incorporated by reference in its entirety.

BACKGROUND

Many organizations are focused on increasing nutrition access and healthful eating, but there is also a need for solutions that effectively engage kids on the playground, keep kids playing more vigorously, and for longer periods, as well.

SUMMARY

Embodiments of an interactive play system are provided. In one such embodiment, an interactive play system includes a satellite having a sensor. The satellite is integrated within a component included within a playground environment. A feedback mechanism is also provided within the playground environment. A computing device supports a selective change between a first programming state in which the feedback mechanism will respond to an actuation of the sensor based on a computer instruction provided by a system administrator and a second programming state in which the feedback mechanism will respond to an actuation of the sensor based on a computer instruction provided by someone other than a system administrator.

DETAILED DESCRIPTION OF ILLUSTRATIVE EMBODIMENTS

Figure 1:
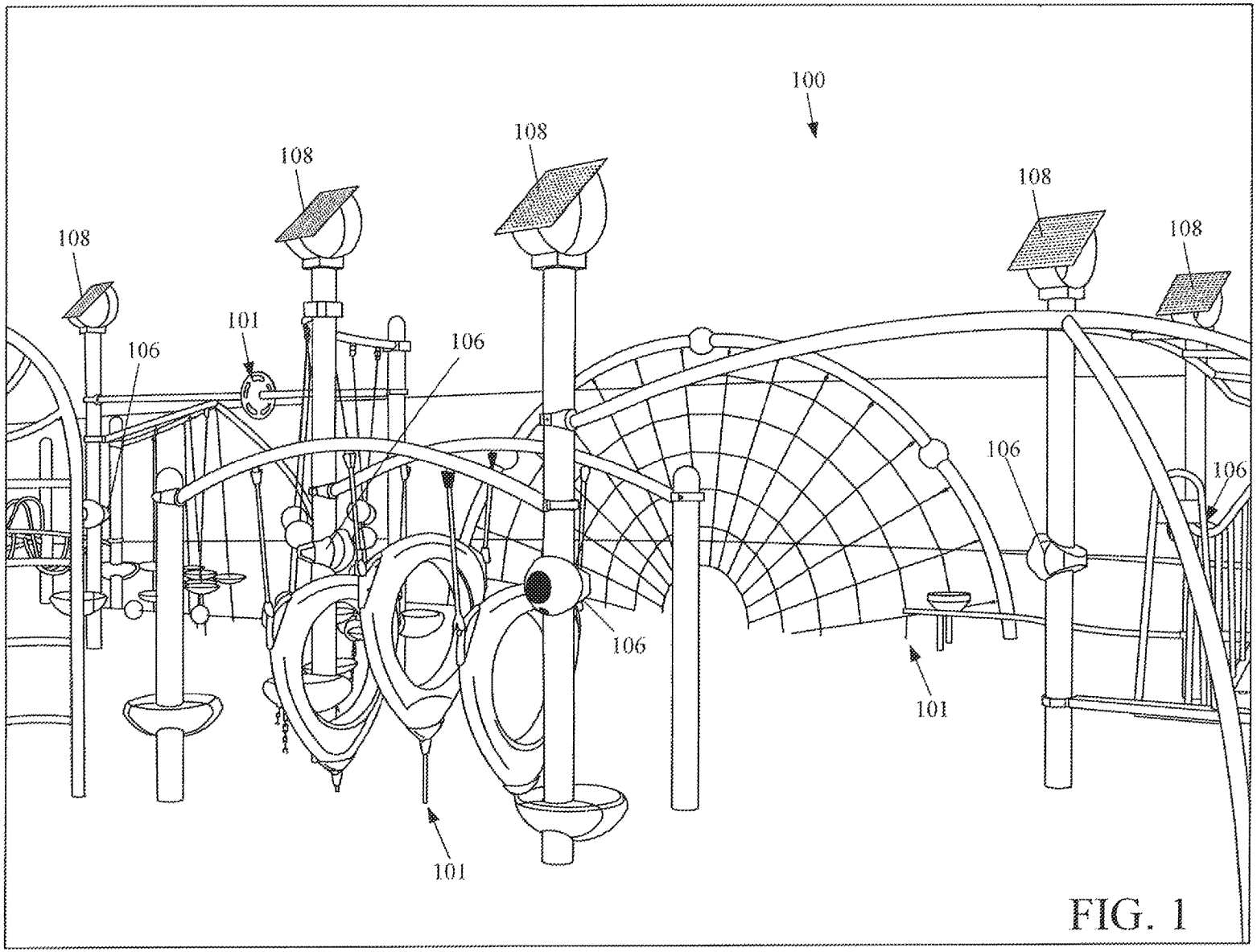
FIG. 1 is a perspective view showing an example play environment.

The current state of integrating technology into playground environments is mostly not dynamic—that is, in many cases, once the technology is installed, the technology is static and non-adaptive. Technology integrated into a playground ideally should be less rigid and more reactive to how kids naturally play to enhance the play experience. In accordance with one aspect of the present invention, a combination of computing power, remote and local computer communications, robust sensors, easy-to-use programming languages, and powerful game development logic offer a re-imagining of how technology is integrated into a static play structure. Even an existing static or mostly static play structure can be converted into an enhanced, smart, and connected play adventure, in according with one aspect of the present invention. In one particular embodiment, at the core of this transformation is a computer (e.g., a Raspberry Pi type computing device) that is integrated into a playground environment and facilitates the processing/storage of play activity data. The computing device optionally communicates the data to a cloud/IoT platform for aggregation with similar data collected from other play environments. The data is also illustratively transferrable between sensors and other devices on the playground itself, to enable a broad range of different play modes and options. The play activity data is derived from the triggering of sensors (e.g., but not limited to radar or other proximity or even touch sensors) that are distributed within the playground environment and configured to be triggered by motion or touch. The sensors are communicatively connected to the computer. In one embodiment, this connection is made via a secure computing network (e.g., a WiFi network) such that all sensors, and feedback mechanisms also distributed within the playground environment, are connected in a way that enables creation and playing of a virtually unlimited number of physical activity-inducing games. Of course, hardwiring the communication paths is also within the scope of the present description. The feedback mechanisms that are programmatically (and even selectively, as will become apparent) linked to sensors so as to activate an provide a response visually (e.g., through LED light arrays) and/or audibly (e.g., through speakers). Notably, while children are playing interactive games in relation to the sensors and feedback mechanisms, data relative to their play activity is anonymously collected and stored with the computer. In one embodiment, that data is provided (e.g., via secured wireless communication) to a central data aggregation facility, where it is combined with data similarly collected from other playground environments. The data is utilized to, for example, as a basis for choosing modifications to playground environments and the described interactive play system (e.g., modifications to the described electron game play and/or physical modifications to play structures, etc.) based on trends and patters identified within the play data. Of course, a single playground environment can be configured such that its local computer includes programmatic logic for adapting and improving the local game and play experience even without data being aggregated with data from other playground environments.

In one embodiment, the electronic games facilitated by the computer, sensors, and feedback mechanisms are created by the backend system administration team and pre-loaded onto the computer in the playground environment prior to installation. In another embodiment; however, the system is configured to support active updates pushed by the system administration team to the computer in the playground environment via a remote connection (e.g., via the Internet/cloud and suitable communications interfaces) or even by simply connecting via a local network that encompasses some or all of the elements within the playground environment. In one embodiment, the computer includes a physical interface and updates are simply directly uploaded. Thus, games and modes of interaction can, in one aspect of the present description, be frequently updated with new play experiences which provides a "sense of surprise" that drives sustained interest by children, resulting in longer periods of play and desire to visit the playground more frequently to see what's new.

In another aspect of the present description, not all changes or updates need come from the system administration team. In one embodiment, the system incorporates the capability for participants in the play experience to change or otherwise program games themselves, for example, using a child friendly programming platform (e.g., the Scratch programming programming). This enables an experiential bridge between the technology/programming world and physical activity, which is a significant benefit especially in disadvantaged communities that may not have access to programming opportunities at home. The programming environment in essence enables children to interactively change the behavior of the playground itself! The format of games and experiences need not be limited to infrequent modified by professional installers. Instead, the experiences in the playground environment can be instantly modified by a child using the child-friendly tools to change the nature of the interaction patterns facilitated by the sensors and feedback components. For example, a child programmer can selectively determine sequences of light and sound on multiple different play structures and selectively link them to movement and/or touch. In one embodiment, the child programmer has access to many if not all capabilities of the programmer who originally writes the interaction and gameplay code for the play environment. Finally, in one embodiment, the programming interface is illustratively presented in a way that children can program in a cooperative manner, utilizing the same or different programming interfaces, so that several children can simultaneously develop code which cooperates together, enabling the child programmer to learn advanced concepts in parallelism. In one embodiment, the programming environment provided to children includes an access granting mechanism that supports management of the deployment of child-written code in a way that precludes overwriting the standard code and which arbitrates access to the system under the control of adult supervision.

In accordance with one aspect of the present description, the child (or other playground user) utilizes a separate computing device (such as but not limited to a laptop, tablet, or mobile phone) to facilitate their writing of the code that is transferred to the main computer in the playground environment, where it is executed by the main computer so as to change the play experience facilitated by the sensors and feedback mechanisms. Thus, there must be a way to transfer the code from the separate computing device to the main computer. In one embodiment, communications system components are provided to enable the child to carry their separate computing device within the playground environment and transfer their code to the main computing device via a wireless or wired network connection. In another embodiment, communication system components are provided to enable the child to transfer their code to the main computing device remotely, from outside of the playground environment. In one embodiment, classroom or programming club activities are facilitated and conducted inside or outside of the playground environment, during which new code scenarios are created. These new code scenarios are remotely or directly uploaded to the main computer in the playground environment. The main computer in the playground environment executes this new code and thus changes the play experience facilitated by the main computer, the sensors and the feedback mechanisms.

In still another aspect of the present invention, the separate computing device upon which new interaction scenarios are created includes a software application configured to facilitate creation and/or transfer of the user created code, as described. In one embodiment, the software for creating the code leverages an existing, at least partially educational software development platform, such as the Scratch programming platform. For example, the Scratch programming platform, as it exists today, supports the creation of custom programming structures and components through extensions. Thus, in one embodiment, an extension is added to an existing programming platform to support a convenient and flexible programming experience. A separate or integrated software application is then provided to facilitate transfer of the code to the main computing device within the playground environment. In one embodiment, software is provide that enables the user to interact with the main playground computer in a way that supports direct triggering of feedback mechanisms within the playground environment. For example, software running on a tablet or other device illustratively includes a simulated button or other component that enables a user to instantly trigger a feedback mechanism (e.g., turn on a light, etc.). In another embodiment; however, code must be uploaded to the computer for subsequent execution in order to support the triggering of feedback mechanisms.

FIG. 1 is a perspective view showing an example playground environment 100. As shown, there are a variety of different play features 101 (some but not all are labeled). Regardless of the illustrated configuration, play features 101 illustratively may include playground equipment such as, but not limited to, climbers, slides, bars, swings, spinners, etc. Also shown in FIG. 1 are interactive satellites 106. Satellites 106 are illustratively configured with at least one sensor that supports passive or direct interaction with a person in the playground environment. In one embodiment, the person passively or intentionally interacts with the sensor and thus the sensor detects user movement through playground environment 100. Satellites 106 are illustratively placed in various locations throughout play environment 100. Thus, the sensors enable a substantially passive monitoring of play usage within environment 100 overall or in relation to individual play features within environment 101. Of course, passive does not necessarily mean that a particular sensor might not incorporate an intentional action, such a press of a button, a spinning of a knob, etc. The mode of interaction is limited only by the type of sensor deployed. In one embodiment, each satellite 106 is powered by a power source. As shown, power source 108 is a solar panel; however, in other examples power source 106 could be a different type of power source, such as, but not limited to a battery or hardwired DC power source.

Figure 2:
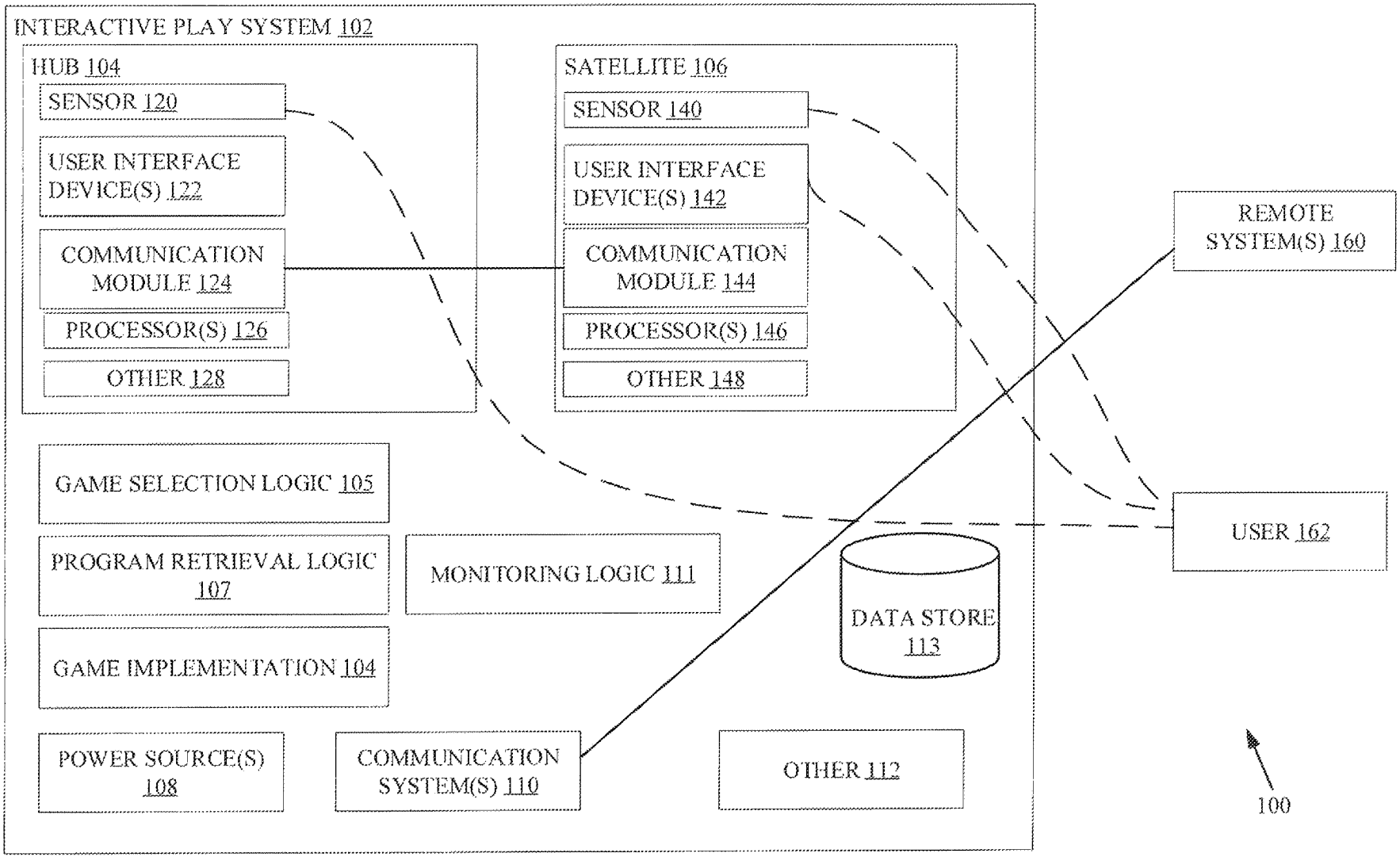
FIG. 2 is a schematic block diagram showing additional features of the example play environment.

FIG. 2 is a schematic block diagram showing other aspects of example playground environment 100. As shown, one or more users 162 interact with an interactive play system 102 that includes some of the features described in relation to FIG. 1, as well as other related features. The interactive play system 102 illustratively includes one or more hub(s) 104, satellite(s) 106, power sources 108, communication systems 110, game selection logic 105, retrieval logic 107, game implementation logic 109, monitoring logic 111, datastore 113 and can include other supporting components as well as indicated by block 112.

In one embodiment, hub 104 is a combination of computer hardware and software configured to enable user 162 to control at least a portion of interactive play system 102. In one embodiment, the hub 104 includes the main computer described above in relation to other embodiments. In one embodiment, hub 104 is deployed, at least in part, as a computer and connected components, such as a Raspberry Pi and functionally connected components. In one embodiment, hub 104 includes connections to one or more sensors 120 that are configured to detect and record a presence of user 162 proximate to the hub 104. In one embodiment, hub 104 includes one or more user interface device(s) 122 that are configured to support interactions by user 162 with hub 104. In one embodiment, user interface device 122 is configured to support selection of the particular code set or game to be executed by the main computer so as to effectuate control over the responses of the other components within the interactive play system 102. For example, in one embodiment, user interface devices 122 include a display, button, touchscreen, lights, speakers, microphones, joysticks, touchpads, or the like, as well as supporting computer processing and software components. In one example, hub 104 includes a tablet style user interface device 122 configured to support selections by user 162 of program or games. In one embodiment, hub 104 includes a communication module 124 configured to support communications between hub 104, satellites 106, and other devices included within the interactive play system 102. In one embodiment, satellite (s) 106, hub 104, and any other related components in system 102 are maintained in contact with one another across a network (e.g., a secured local network), such that other devices cannot access data being transmitted between the components or interrupt normal operations of the system.

Hub 104 also illustratively includes processors 126 (e.g., part of the main computer) that control the features of hub 104 based on stored computing instructions that may or may not be periodically updated and changed. For example, game selection computing logic 105, retrieval computing logic 107, game implementation computing logic 109 and monitoring computing logic 111 are illustratively implemented by one or more of processor(s) 126. Of course, hub 104 can include other items as well, as indicated by block 128.

Satellite(s) 106 illustratively include one or more sensor(s) 140 that are configured to sense a presence of one or more users 162 in an area proximate satellite 106. For example, sensors 140 illustratively include any or all of touch, radar, ultrasonic or other proximity type sensors. In one embodiment, satellite 106 includes one or more user interface devices 142 that a user 162 utilizes to interact with satellite 106/interactive play system 102. The user interface devices 142 can but do not necessarily include buttons, touch screens, speakers, etc. User interface devices 142 on satellites 106 illustratively enable users 162 to play games across interactive play system 102. For example, in one embodiment, satellites 106 are activated by touch and/or user 162 proximity and respond to user 162 via lights and/or sounds under the software driven execution games stored in the hub and chosen via game selection logic 105. Game selection logic 105 is illustratively configured to support a user 162 in the selection of a game to choose and play across hub 104 and satellites 106. For instance, game selection logic 105 may generate an interface on a display of hub 104 that allows a user 162 to select and play a particular game. In one embodiment, a user is thus able to switch back and forth between sets of code or games provided by the backend administrative team and/or sets of code or gams provided by users, as has been described.

Retrieval logic 107 is also illustratively software implemented logic and illustratively is configured to support play system 102 in the retrieval of data, a program, a game or the like from a remote system 160 (e.g., communicated from the backend administrative team) or communicated or provided into the system by a user via a remote or directly physical interface. In one embodiment, a user 162 creates a game or other application on one device and uploads it to interactive place system (e.g., datastore 113) via a communication interface (e.g., a wireless or even a physical interface such as a USB interface) and retrieval logic 107. In another embodiment, retrieval logic 107 is configured to receive pushed updates from a remote system 160. For instance, learned data or programming instructions from another system is illustratively pushed to enable adaptation to natural play patterns. Finally, retrieval logic 107 is illustratively configured to monitor for and generally prevent any nefarious program transmitted from an untrustworthy source.

Game implementation logic 109 is also illustratively software implemented logic and illustratively facilitates the execution of the games and other programs within the interactive play system 102. In one embodiment, implementation logic 109 implements a game across one or more hub 104*s* and the various satellites 106, such as a program that a user has selected via game selection logic 105 or a program uploaded via retrieval logic 107.

Monitoring logic 111 is also illustratively software implemented logic and illustratively utilizes sensors 120 and/or 140 to monitor users 162 across interactive play system 102. In one embodiment, monitoring logic 111 stores related information in data store 113 or utilizes communication system 110 to send related data to one or more remote systems 160, for example, a centralized data aggregation system that aggregates data from many different playground environments. Monitored data, in one embodiment, is indicative of movement and play activity of users 162 across play environment 100, the size of users 162, etc. Since data indicative of child movement may be considered sensitive, this data is, in one embodiment, is encrypted.

Power sources 108 illustratively includes any or all of solar sources, hardwired sources, batteries, generators, etc. Communication systems 110 illustratively includes any or all of cellular network facilitated communication, hardwired network communication, wireless network communication, etc. communication protocols. Of course, interactive play system 102 can include other items as well, as indicated by block 112, including all components necessary to support any or some other communications technology.

Figure 3:
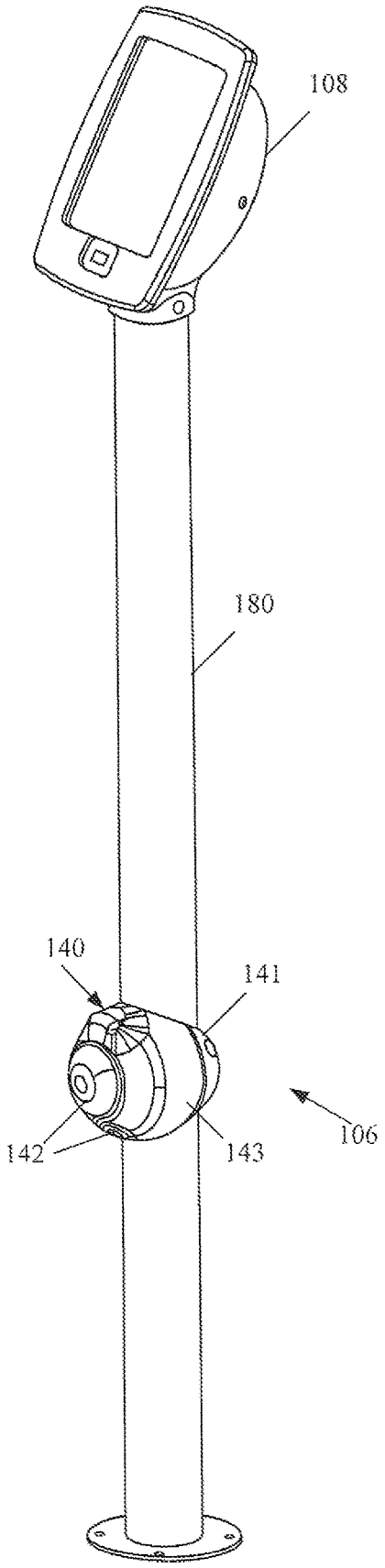
FIG. 3 is a perspective view showing an example satellite.

FIG. 3 is a perspective view showing an example satellite 106. Satellite 106 as shown includes power supply 108, a sensor 140, a user interface mechanisms 142 and a pole 180. Pole 180 as shown, is a standard playground pole upon which the components of satellite 106 are mounted. Satellite 106 includes the housing 143, which is coupled to the pole 180 via a clamp portion 141. In one embodiment, as shown but not by limitation, sensor 140 includes a radar type sensor located within the housing 143 such that the sensor detects users that are proximate satellite 106. As shown, user interface mechanism 142 includes a touch sensitive button and a speaker. However, in other examples user interface mechanisms 142 can include any combination of components (more or fewer, even), as the system is designed in a modular manner. Power supply 108 provides all necessary power to satellite 106. In some examples, antenna may be provided in power supply 108 to amplify signals sent from satellite 106 to another device (e.g., hub 104).

Figure 4:
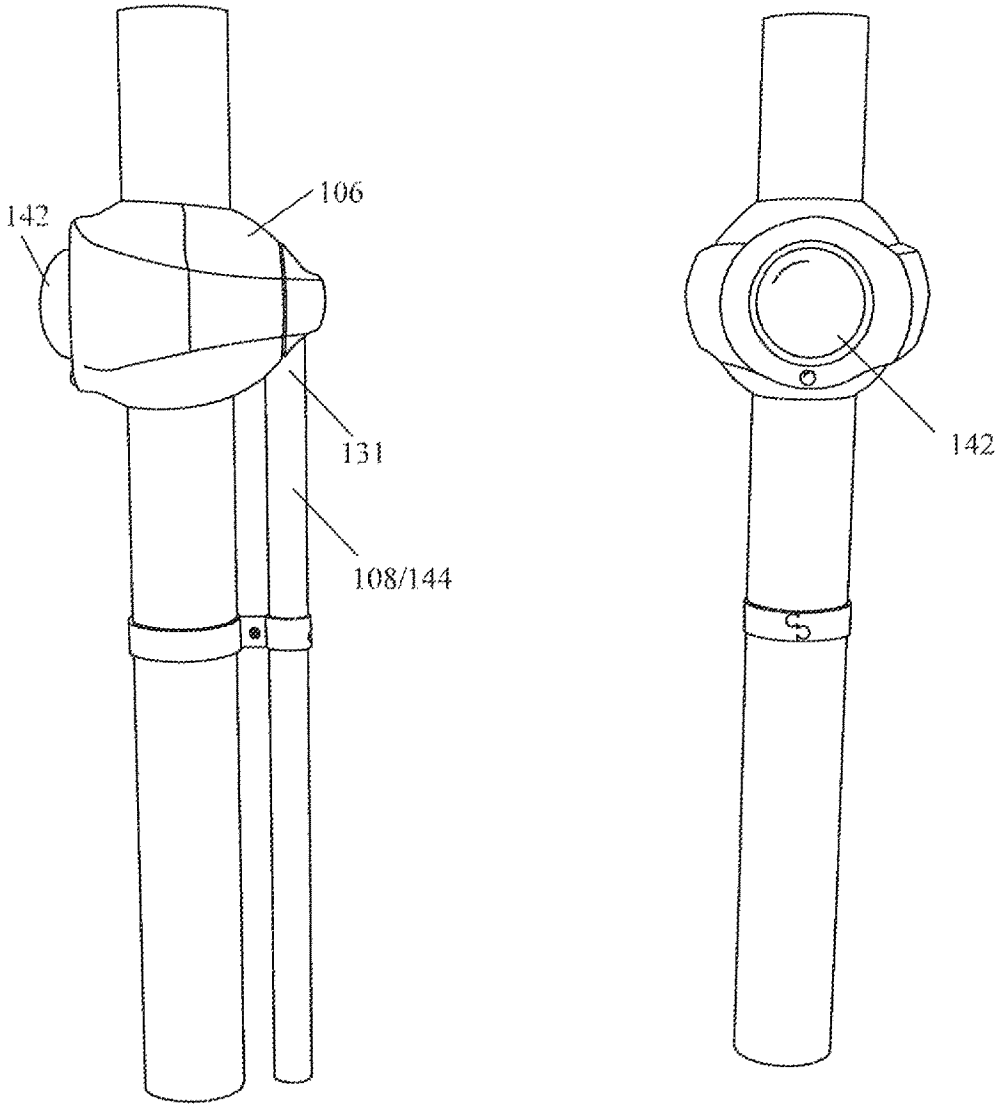
FIG. 4 is a perspective view showing example satellites.

FIG. 4 is a perspective view showing examples of satellites 106 having a hard wire connection. As shown, satellites 106 are coupled to a hard-line 131 that can include both a power supply 108 and/or a communication module 144.

Figure 5:
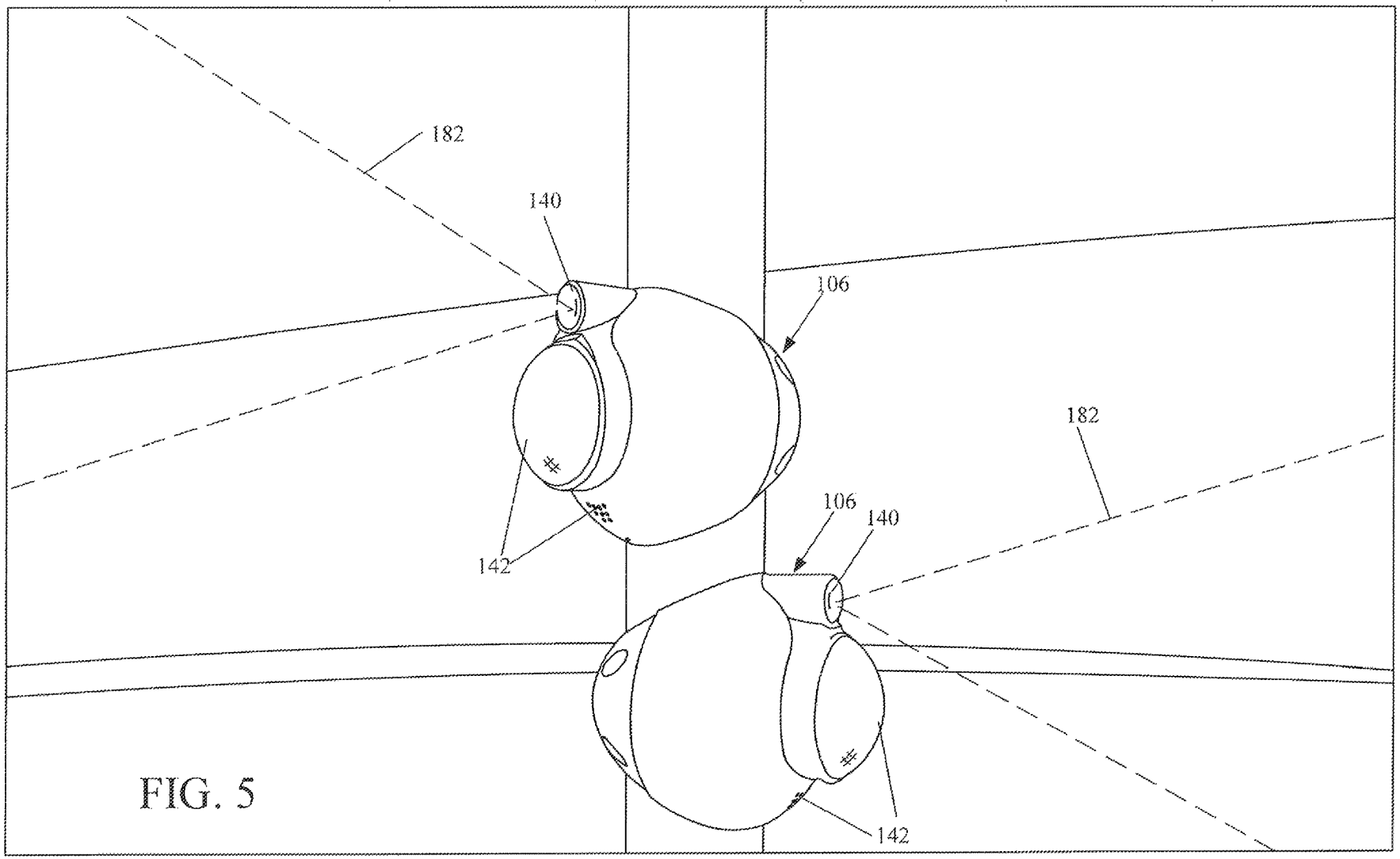
FIG. 5 is a perspective view showing an example sensory range of a satellite.

FIG. 5 is a perspective view showing an example sensory range of satellite 106. As shown sensors 140 are radars that detect users within a sensing range 180. In other examples, sensing range 182 can be oriented differently than shown to detect different characteristics of users in the play environment. For example, sensing range 182 can be angled such that the height of users can be detected which may lead to a determination if they are children or adults or even the age of children. In another embodiment, sensor 140 is configured to detect movement speed, direction or other attributes of users passing within sensing range 182.

Figure 6:
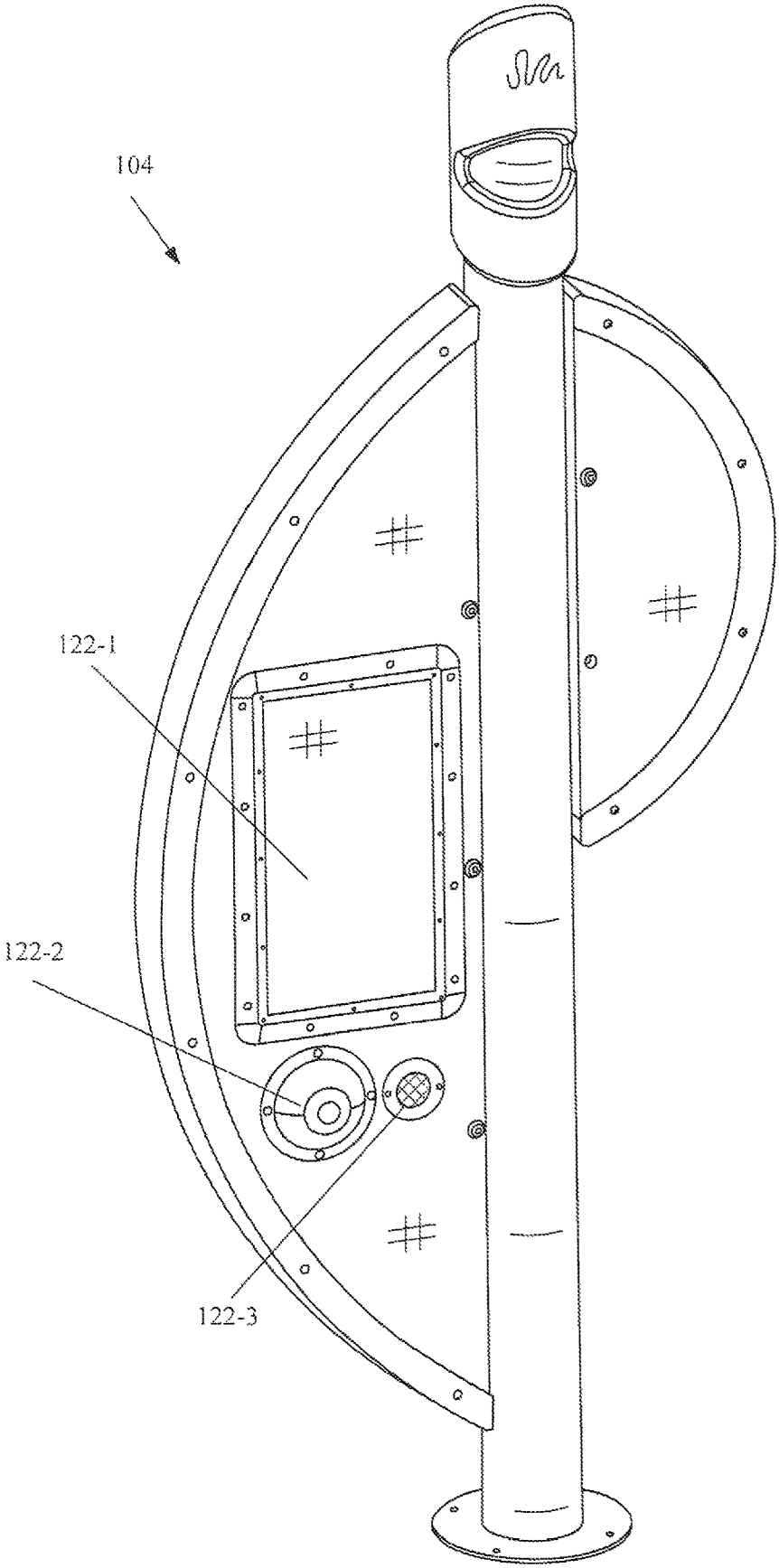
FIG. 6 is a perspective view showing an example hub.

FIG. 6 is a perspective view showing an example hub 104. As shown, hub 104 includes a variety of user interface mechanisms 122. User interface 122-1, as shown, is a display screen. In one embodiment, interface 122-1 is an interactive tablet computing interface that enables, for example, the programming of games by children directly, and/or facilitation of uploading or selection of code/games. The display screen can be can comprise a plurality of RGB LEDs or can include a high-resolution LED, LCD or other type of display device. User interface device 122-2, as shown, is a touch sensitive button. The button can include a variety of different RGB lights to elicit feedback or can provide haptic feedback (vibration, etc.) or other forms of feedback. User interface mechanisms 122-3, as shown, is a speaker that can provide audio feedback to a user. In other examples, interface device 122-2 can include a joystick or touch pad, etc. The hub can be powered via a solar panel or a hardwired DC power source.

Although the present invention has been described with reference to preferred embodiments, workers skilled in the art will recognize that changes may be made in form and detail without departing from the spirit and scope of the invention.

What is claimed is:

1. An interactive play system comprising:

a satellite having a sensor, the satellite being integrated within a component included within a playground environment;

a feedback mechanism provided within the playground environment; and a computing device that supports a selective change between a first programming state in which the feedback mechanism will respond to an actuation of the sensor based on a computer instruction provided by a system administrator and a second programming state in which the feedback mechanism will respond to an actuation of the sensor based on a computer instruction provided by someone other than a system administrator.

2. The interactive play system of claim 1, further comprising an interactive display integrated within a component included within the playground environment, the interactive display supporting a user input that enables a switch between the first and second programming states.

3. The interactive play system of claim 2, wherein the interactive display supports the transition between the first and second programming states by enabling a switch between a first game provided by the system administrator and a second game provided by someone other than the system administrator.

4. The interactive play system of claim 3, wherein the game provided by someone other than the system administrator is a game uploaded to the computing device by someone other than the system administrator.

5. The interactive play system of claim 1, wherein the first programming state is a factory set, pre-programmed programming state.

6. The interactive play system of claim 1, wherein the second programming state is not a factory set, pre-programmed programming state.

7. The interactive play system of claim 1, wherein the computing device stores a record of a triggering of the sensor.

8. The interactive play system of claim 1, wherein the computing device transmits a record of a triggering of the sensor to a remotely communicatively connected second computing device.

9. The interactive play system of claim 1, wherein the feedback mechanism is a light integrated within the playground environment.

10. The interactive play system of claim 1, wherein the feedback mechanism is an audio transmitting device integrated within the playground environment.

11. A playground data aggregation system, comprising:

a first satellite having a first sensor, the first satellite being integrated within a first component included within a first playground environment, wherein the first satellite includes a first sensor;

a first computing device that makes a record of a triggering of the first sensor, wherein the first computing device integrates the triggering of the first sensor into an interactive game played within the first playground environment;

a second satellite having a second sensor, the second satellite being integrated within a second component included within a second playground environment, wherein the second satellite includes a second sensor, and wherein the first and second playground environments are separated by distance from one another so as to be in different geographic locations;

a second computing device that makes a record of a triggering of the second sensor, wherein the second computing device integrates the triggering of the second sensor into an interactive game played within the second playground environment, wherein said interactive game played within said first playground environment is different than said interactive game played within said second playground environment; and a remote data aggregator that receives the record of the triggering of the first sensor from the first computing device and combines it with the record of the triggering of the second sensor, which is received by the remote data aggregator from the second computing device.

12. The interactive play system of claim 11, wherein the first component and the second component are the same type of components.

13. The interactive play system of claim 11, wherein the first computing device supports a reprogramming of the interactive game played within the first playground environment based on instructions communicated from someone other than a system administrator.

14. The interactive play system of claim 11, wherein the reprogramming of the interactive game played within the first playground environment is facilitated by a first interactive display integrated into another playground component within the first playground environment.

15. The interactive play system of claim 11, wherein the first computing device supports a reprogramming of the interactive game played within the first playground environment based on instructions communicated from a system administrator from a location outside of the first playground environment.

16. A computer implemented method of programming a game deployed within a playground environment, the method comprising:

receiving a game programming instruction; and changing a relationship between a sensor and a feedback mechanism, the sensor and the feedback mechanism being integrated into separate playground components within the playground environment, the separate playground components being displaced from one another so as to be in different locations within the playground environment, and wherein changing the relationship further comprises changing from a factory set relationship to a relationship reflected in an input provided by a person other than a system administrator.

17. The method of claim 16, further comprising storing a record of interactions with the sensor.

18. The method of claim 17, further comprising transmitting a record of an interaction of with the sensor to a remotely communicatively connected computing device.

19. The method of claim 16, wherein receiving a game programming instruction comprises receiving a game programming instruction as part a user submitted game scenario.

20. The method of claim 16, wherein receiving a game programming instruction comprises receiving a game programming instruction communicated from a separate computer device.

* * * * *